United States Patent [19]

Lipford

[11] Patent Number: 5,060,404

[45] Date of Patent: Oct. 29, 1991

[54] AUGER TYPE DREDGING HEAD

[75] Inventor: Keith W. Lipford, Pasadena, Md.

[73] Assignee: Ellicott Machine Corporation, Baltimore, Md.

[21] Appl. No.: 552,502

[22] Filed: Jul. 16, 1990

[51] Int. Cl.[5] ..... E02F 3/92

[52] U.S. Cl. ..... 37/64; 37/72

[58] Field of Search ..... 37/64, 65, 66, 67, 68, 37/69, 72

[56] References Cited

U.S. PATENT DOCUMENTS

| | | | |
|---|---|---|---|
| 444,099 | 1/1891 | Humphreys | 37/72 X |
| 1,808,066 | 6/1931 | Plummer | 37/72 |
| 3,521,387 | 7/1970 | Degelman | 37/72 X |
| 3,962,803 | 6/1976 | O'Brien | 37/66 |
| 3,971,148 | 7/1976 | Deal | 37/66 |
| 4,146,982 | 4/1979 | Norisugi | 37/64 |
| 4,942,682 | 7/1990 | McDowell | 37/189 X |

FOREIGN PATENT DOCUMENTS

| | | | |
|---|---|---|---|
| 266741 | 11/1986 | Japan | 37/65 |

*Primary Examiner*—David H. Corbin
*Assistant Examiner*—Arlen L. Olsen
*Attorney, Agent, or Firm*—Scrivener and Clarke

[57] ABSTRACT

An auger type dredge head may be mounted on a dredge ladder in a selected angular position with respect to the ladder axis, for sweeping or fore and aft operation, and a selected angular position may be set and maintained with respect to the dredge barge. The head has movable shrouds on opposite sides of the auger, the shrouds carrying doors which open automatically to eject matter too large to be accommodated by the dredge suction pipe. The shrouds have sloping fins on their inner faces to aid in the movement of dredged material to a centrally located suction pipe inlet.

10 Claims, 7 Drawing Sheets

AUGER TYPE DREDGING HEAD

This invention relates to sub-aqueous dredging apparatus and more particularly to a dredging head of the auger type.

BACKGROUND OF THE INVENTION

Auger type dredging heads are well known and usually comprise horizontal augers which are advanced along the bottom transverse to its path of movement similar to a reel-type lawn mower, see, for example, the patent to O'Brien U.S. Pat. No. 3,962,803 now assigned to the same assignee as the present invention. Such dredges have a pair of oppositely spiraled digging fins mounted on a common shaft and arranged that as the shaft is rotated the dredged material is moved by the spiraled fins towards the center where the inlet opening for a suction pipe is located.

It is also known to mount an auger type dredge head of the foregoing nature at the end of a dredge ladder but with the auger axis parallel to the axis of the ladder. With this arrangement the dredge operates with a side-to-side sweeping motion similar to a cutter head dredge. Such a dredge is shown in the patent to Norisugi U.S. Pat. No. 4,146,982.

A problem with both types of prior auger type dredges referred to above is that the dredge heads are designed to be mounted in one position only, either for linear movement as in the case of the O'Brien dredge or for sweeping movement as in the case of the Norisugi dredge.

Furthermore, because auger dredges usually operate adjacent the surface of a waterway bottom for the purpose of removing vegetation or other bottom material, heretofore strainer means have sometimes been provided in front of the auger to exclude solid bottom material, such as rocks, too massive to enter the inlet opening of a suction pipe from reaching the auger. The problem with a strainer is that it can be easily clogged causing frequent shut down to clear the strainer.

SUMMARY OF THE INVENTION

One of the objects of the present invention is to provide an auger type dredge head which may be selectively connected to a dredge ladder in one of a plurality of angular positions relative to the ladder axis, at least one of those positions being transverse to the ladder axis and at least another of those positions being parallel to the ladder axis.

Still another object of the invention is to provide an auger type dredge head which may, in addition, be selectively positioned at an angle relative to the dredge barge with means being provided to ensure that the dredge head remains at that angle as the ladder is raised or lowered.

Still another object of the invention is to solve the problem of oversized bottom material by eliminating strainer means and providing spring loaded doors on the trailing walls of the dredging chamber through which massive material is automatically ejected when moved theretowards by the auger.

Other objects and their attendant advantages will become apparent as the following detailed description is read in conjunction with the accompanying drawings wherein:

DESCRIPTION OF THE PREFERRED EMBODIMENT

Figure 10:
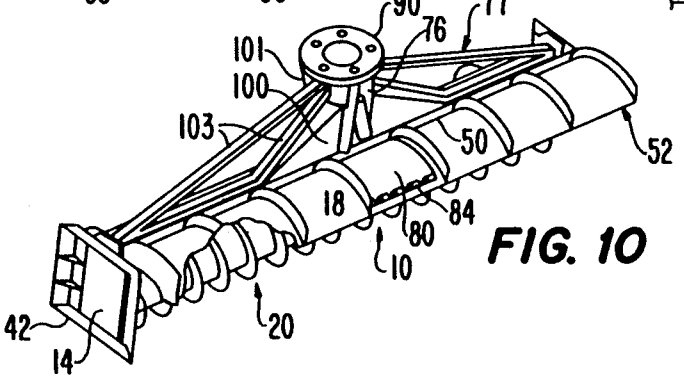
FIG. 10 is a perspective view, on a reduced scale and with parts broken away, of the dredge head of the invention.
Figure 5:
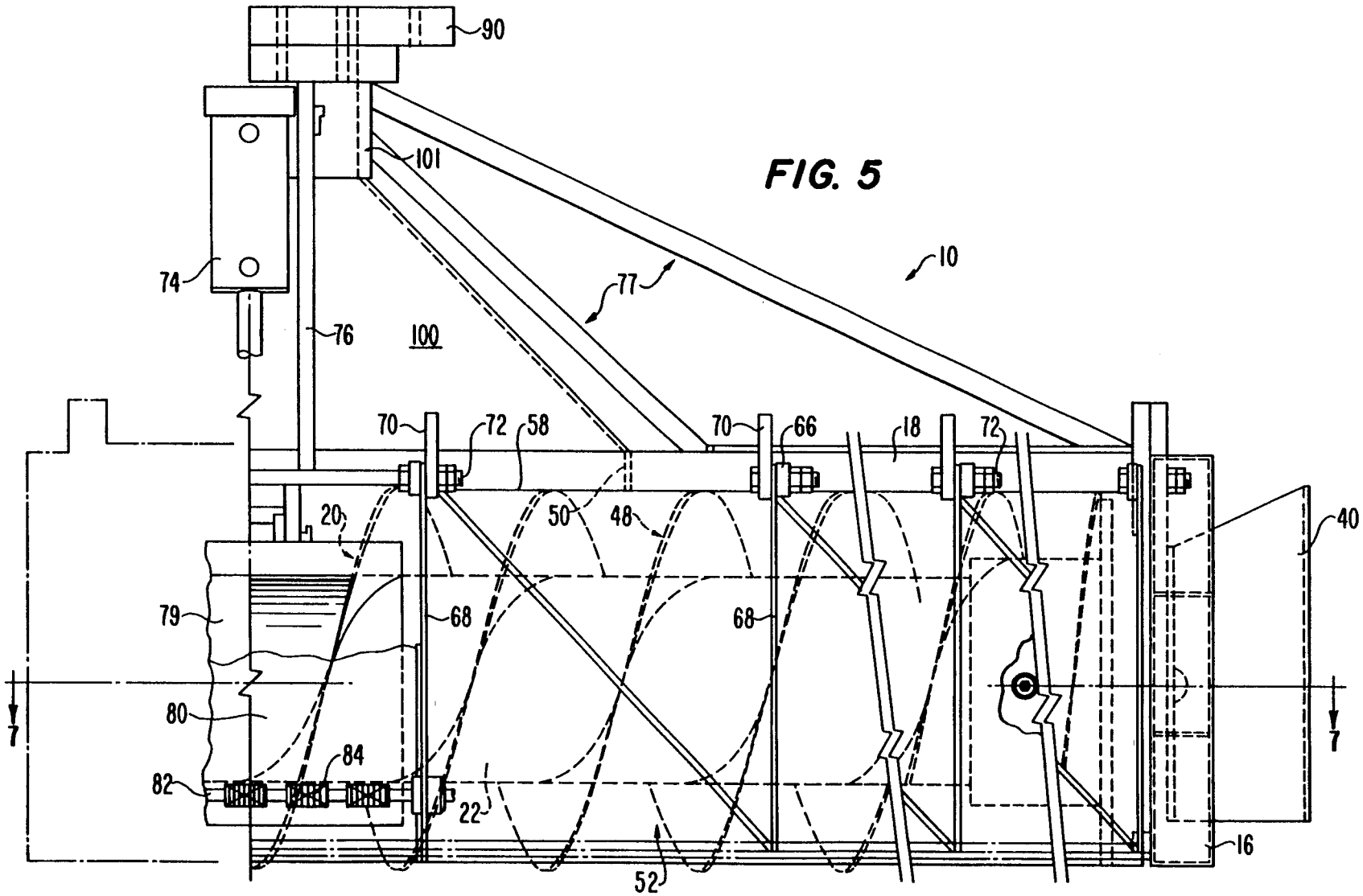
FIG. 5 is an enlarged broken front elevational view of one-half of the dredging head assembly of the present invention.
Figure 6:
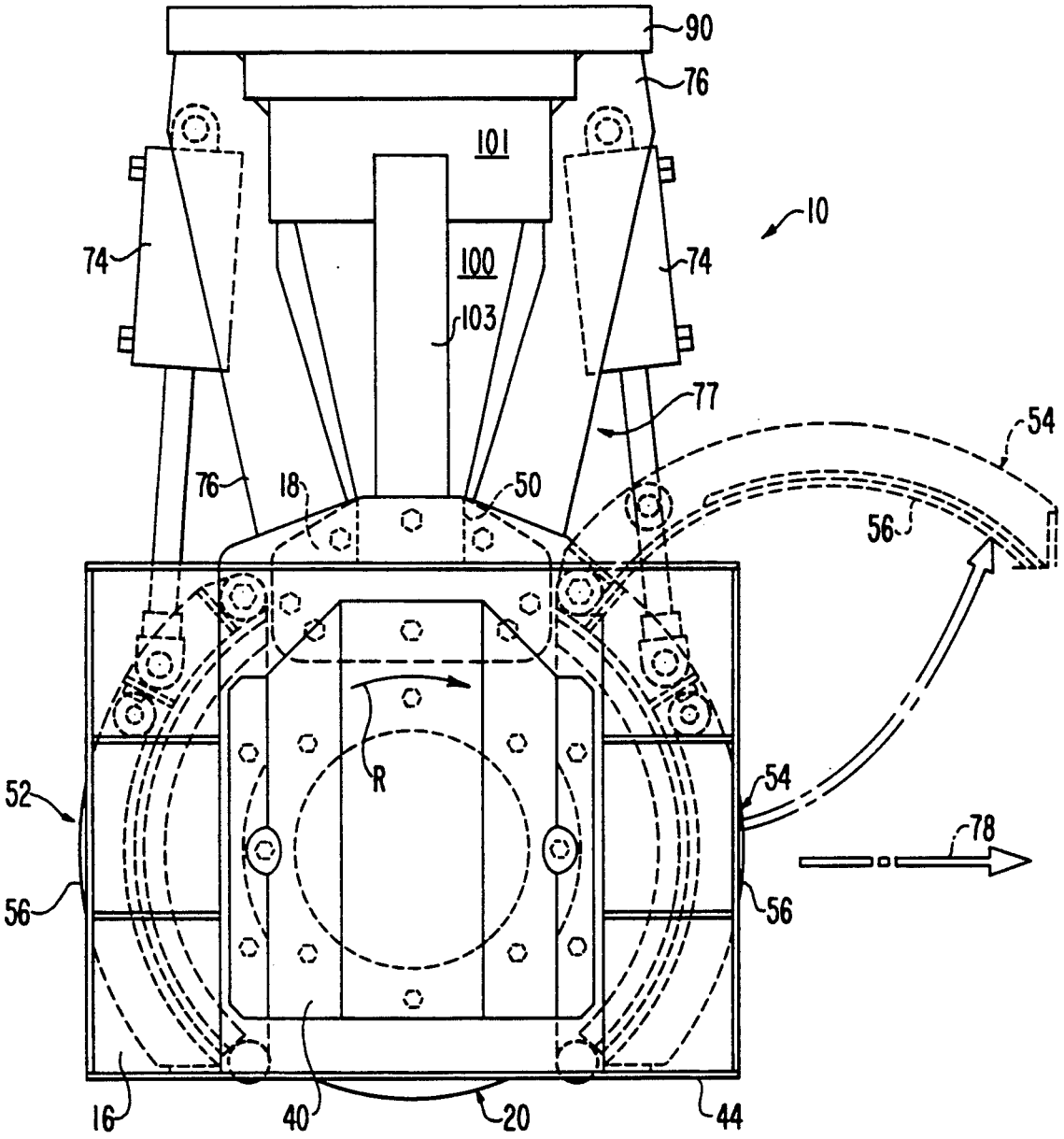
FIG. 6 is an end elevational view of the apparatus of FIG. 5.
Figure 7:
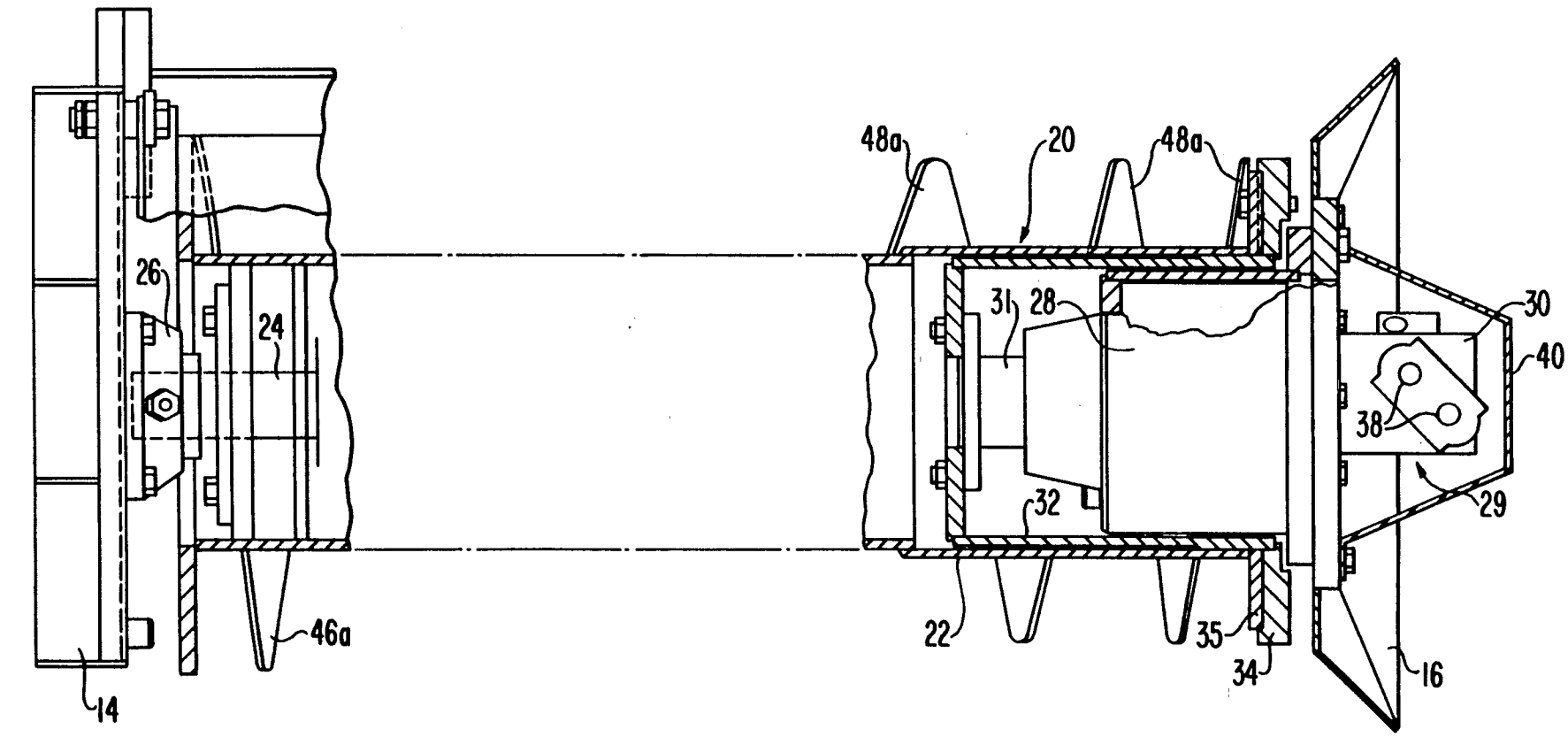
FIG. 7 is a broken horizontal cross sectional view taken substantially on the line 7—7 of FIG. 6.

Referring now to the drawings the numeral 10 designates an auger type dredging head constructed in accordance with the invention. With particular reference to FIGS. 5, 6 7 and 10, it will be observed that the dredging head 10 comprises an elongated inverted U-shaped frame 12 having left and right vertical end walls 14, 16 joined in spaced relation by a horizontal component 18. An auger digger, indicated generally by the numeral 20, comprises a hollow central shaft 22 having its opposite ends journaled in the end walls 14, 16. With reference to FIG. 7, it will be observed that the left end of the hollow shaft carries a stub shaft 24 journaled in a bearing 26 connected to the inner face of the end wall 14. Connected to the right wall 16 (FIG. 7) is a cylindrical housing 28 supporting a conventional hydraulic drive assembly generally indicated by the numeral 29 and including a hydraulic motor 30. The output shaft 31 of the drive assembly 29 is connected to a cylindrical member 32 journaled on the exterior of the housing 28, the member 32 having welded thereto a vertical flange 34 bolted to a flange 35 welded to the right hand end of the hollow auger shaft 22. The assembly 29 includes ports 38 for connection to a remotely located source of hydraulic power (not shown), and surrounding the motor 30 is a cover member 40 generally trapezoidal in horizontal cross section. As indicated in FIGS. 6 and 10, the end walls 14, 16 have flat lower edges 42, 44 for engaging the bottom and limiting the depth the head can penetrate into the bottom.

Figure 4:
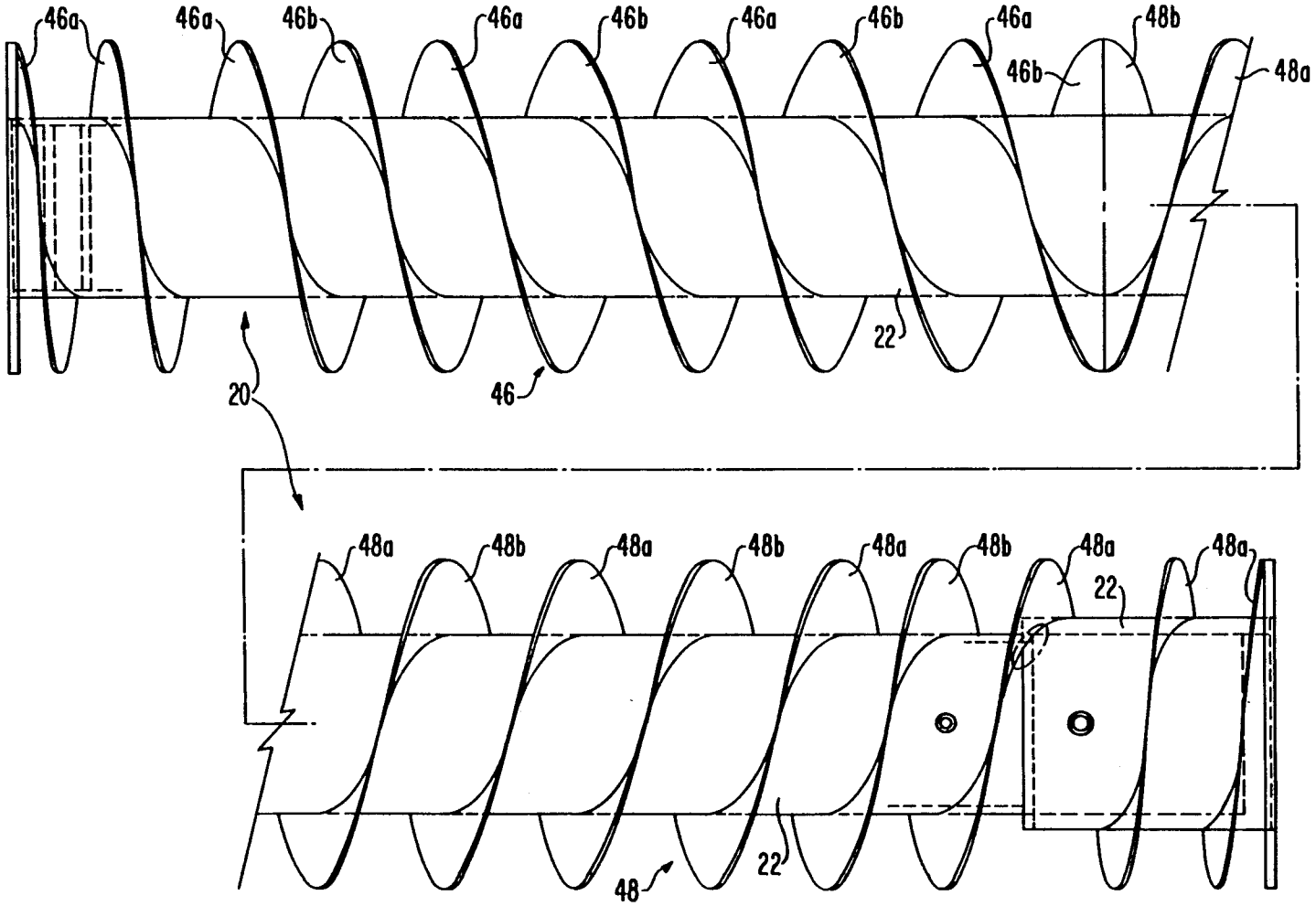
FIG. 4 is an enlarged view of an auger used with the invention.

With reference now to FIG. 4 the auger 20 includes first and second sets 46, 48 of oppositely spiraled digging fins so arranged that when the hydraulic drive assembly 29 is operated, it rotates the shaft 22 in a direction, clockwise when viewed towards the right end of FIG. 4, whereby the fin sets 46, 48 propel dredged material towards the center of the frame 12. It will be observed in FIG. 4 that each set of fins 46, 48 is composed of a pair of spiral fins designated 46*a* and 46*b* for the left hand set 46, and 48*a* and 48*b* for the right hand set 48. Because the dredged material tends to crowd into the center region of the auger, a more uniform delivery to that region results when the pitch of each spiral fin of a set is varied, the pitch being generally less near the ends than the center. For example, in an actual auger used with the invention where the distance between an end and the center of the auger is 66", the first pitch between the first and second flights from the left in FIG. 4 is 5"; between the third and fourth flights, 8"; between the fourth and fifth flights 12" and between the fifth and sixth, and sixth and seventh 16". The second spiral fin **46*b* begins between the third and fourth flights of the first fin 46*a*, as shown in FIG. 4, and continues to the center of the auger with each flight of the second fin being located between two flights of the first. In the actual auger, the spacing between the third flight of the first spiral fin 46*a* and the first flight of the second fin 46*b* is 6", the pitch between the first and second flights of the fin 46*b* is 14", and between the second and third and the third and fourth flights is 16". The described spacing results in uniform, relatively wide spacing between the flights of the two spiral fins nearer the center and relatively narrow spacing between the flights adjacent the ends of the auger. Thus those flights adjacent the center have increased capacity to accommodate both the material being transferred thereto from the ends as well as the material which the center flights dig in their own right whereby the dredged material is delivered to a suction pipe inlet opening 50 (FIG. 5**) at the center of the dredging head and further described hereinafter, at a rate commensurate with the capacity of the suction pipe inlet whereby little or no dredged material is thrown clear of the head due to inability of the suction pipe inlet to withdraw dredged material at the same rate as it is delivered thereto by the auger fins.

Figure 8:
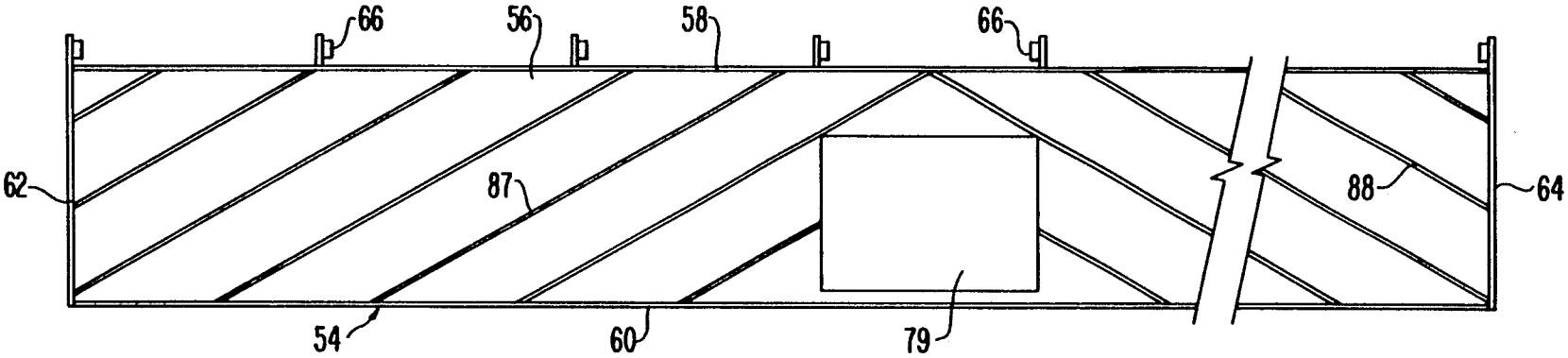
FIG. 8 is a partly broken elevational view looking towards the inside surface of a shroud constructed in accordance with the invention.
Figure 9:
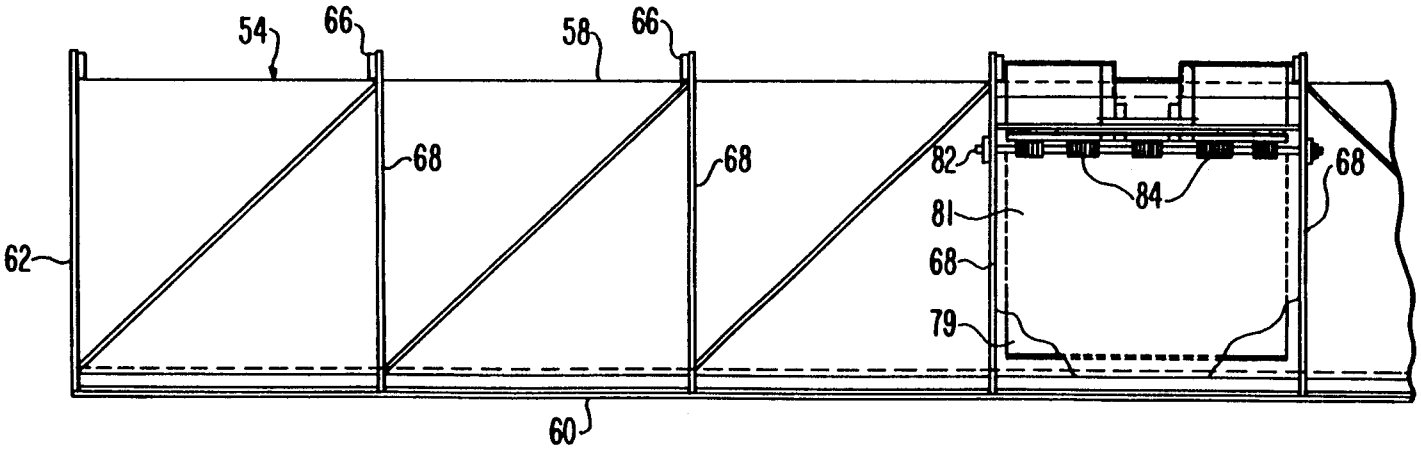
FIG. 9 is a broken, somewhat enlarged elevational view of the exterior surface of the shroud of FIG. 8.

In accordance with the invention, the dredging head includes first and second shrouds 52, 54 best seen in FIGS. 6, 8 and 9. Both shrouds are substantially identical and a description of one applies to both except as noted below. As best seen in FIGS. 8 and 9, each shroud comprises an arcuate wall part 56 substantially complementary in curvature to the circle defined by the radius of the digger fins, see FIG. 6. The wall part 56 has upper and lower edges 58, 60 spaced apart a distance substantially equal to the diameter of the auger and end edges 62, 64 spaced apart a distance substantially equal to the length of the auger. Means are provided for pivotally connecting the upper edges 58 of each shroud to the horizontal component 18 of the frame 12, such means preferably comprising horizontally disposed socket members 66 fixed to the extended upper ends of vertical braces 68 fixed as by welding to the outer side of the shroud wall 56. The upper horizontal frame component 18 has spaced apertured ears 70 (FIG. 5) welded thereto complementary in spacing to the sockets 66 with pivot pins 72 passing through the ear apertures and sockets to hingedly connect the two shrouds to the frame.

Figure 3:
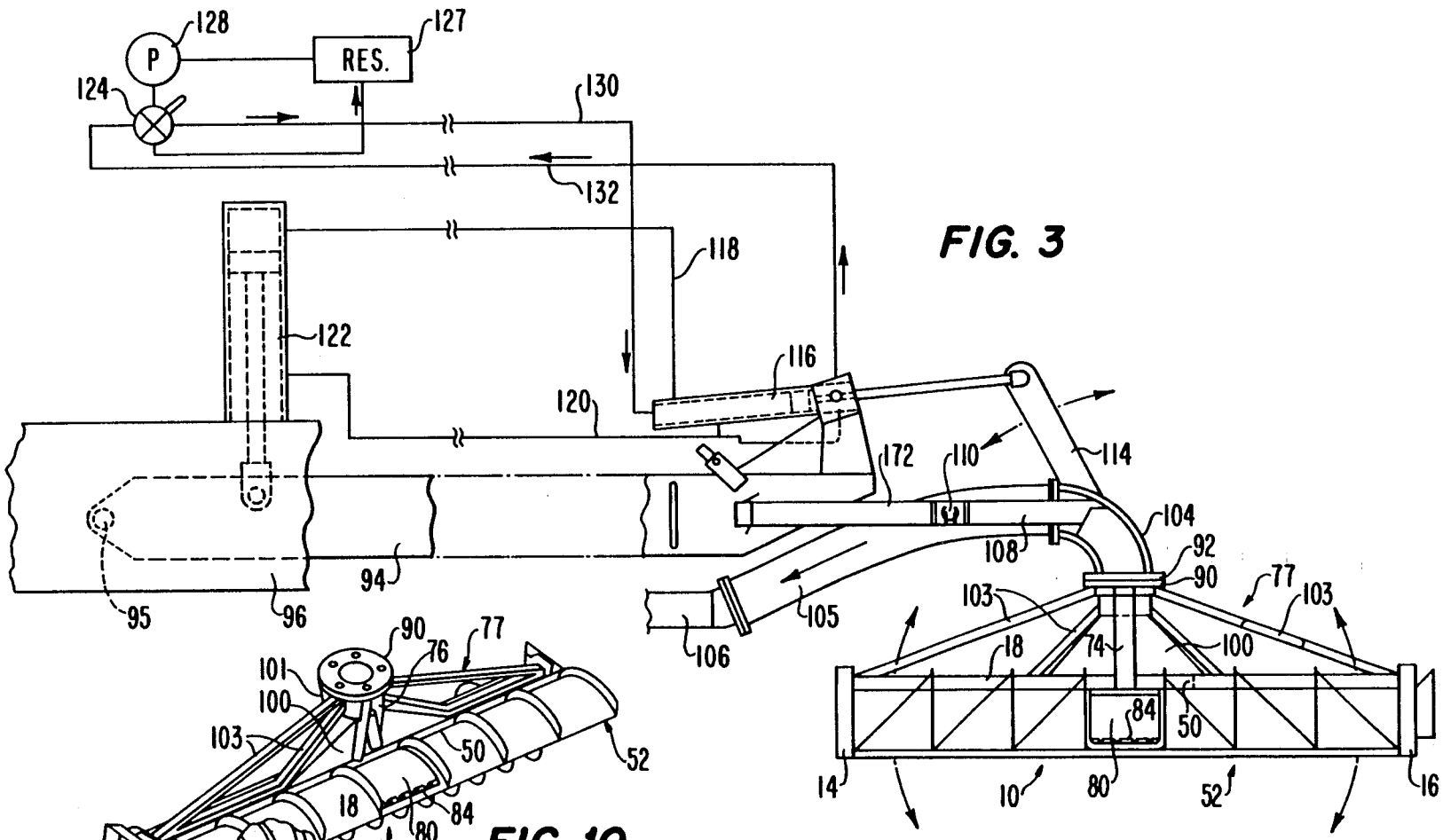
FIG. 3 is an enlarged partly schematic view showing the means for adjusting the angle of tilt of the dredge head with respect to the dredge barge.

Remotely controlled power means such as the hydraulic cylinders 74 best seen in FIG. 6 are carried by paired side braces 76 of a digger support frame 77, hereafter described in more detail, and which may be selectively operated to move the shrouds between raised and lowered positions, it being understood that when the unit is parallel to the axis of a dredge ladder as shown in FIG. 3 and is being swept to the right in the direction of the arrow 78 seen in FIG. 6, the right hand shroud 54 is raised to permit free access of bottom material to the auger whereas the left hand shroud 52 is closed to cooperate with the bottom and end walls 14, 16 to confine dredged material within the enclosure defined by the digger frame and closed shroud. The position of the shrouds are reversed when the unit sweeps in the opposite direction.

A problem faced by auger type excavators is that they occasionally pick-up large chunks of unyielding bottom material, such as rocks, small enough to be conveyed by the auger spirals towards the center but too large to enter the suction inlet 50. Prior to the present invention this problem had sometimes been catered to by the use of strainer bars fixed to the frame on either side of the auger. Though such bars are effective to exclude large objects such as rocks from the auger, they retain the rocks and also tend to collect vegetation which can impede dredging to the point requiring dredging to be stopped until the strainer bars are cleared of any retained rocks and vegetation. The present invention solves this problem by providing openings 79 in the center part of each shroud as best seen in FIGS. 5, 8 and 9. The openings 79 are maintained normally closed by doors 80, 81 carried by the respective shrouds 52, 54. The door 81 of shroud 54 (see FIG. 9) is preferably hingedly supported adjacent its upper edge on a pivot pin 82 extending between two central vertical braces 68, as seen in FIG. 9, the other door 80 carried by shroud 52 is hingedly supported in the same fashion adjacent its lower edge as seen in FIG. 5. The doors are oppositely hinged so that the respective hinges are closest to any point on the auger as it approaches a door during rotation in the direction of the arrow R (FIG. 6). In accordance with the invention, this arrangement of the doors has been found to be particularly desirable because it facilitates the opening of the doors by rocks or the like as they are moved towards the center by the auger as the head is swept in one direction or the other. Coil torsion springs 84 react against the doors and the edges of the openings 79 to bias at all times the doors 80, 81 to their closed positions.

In accordance with the invention, it has been discovered that movement of dredged material towards the center of the dredging head can be enhanced by the provision of sloping fins 87, 88 on the inner faces of the shrouds as best seen in FIG. 8. The respective fins 87, 88 slope in a direction complementary to the direction of spiral of the auger digger fins 46, 48 whereby, when a shroud is in a lowered position, each set of shroud fins 87 or 88 cooperates with a spiral auger digger fin or fins to aid in guiding dredged material towards the suction pipe inlet 50 at the center of the apparatus. It will be understood that the fins on the second shroud and corresponding to the fins 87, 88 slope in a direction opposite to the fins as shown in FIG. 8.

Figure 1:
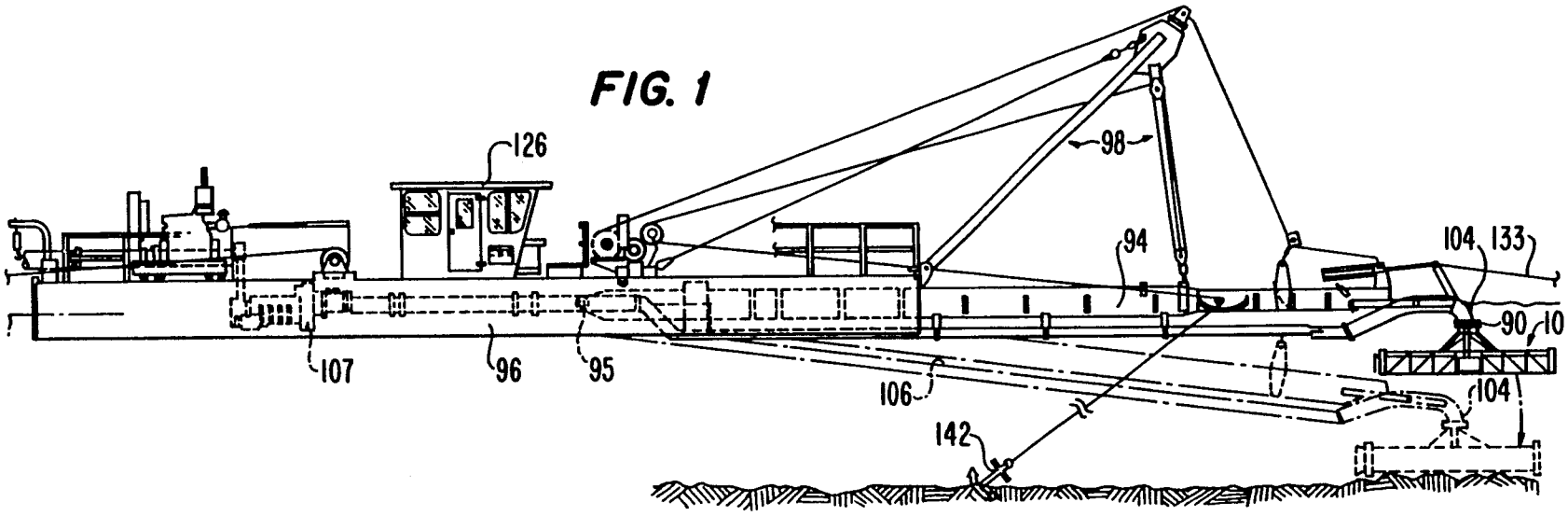
FIG. 1 is a side elevational view of dredging apparatus showing the dredging head of the invention in one of its positions of use.
Figure 2:
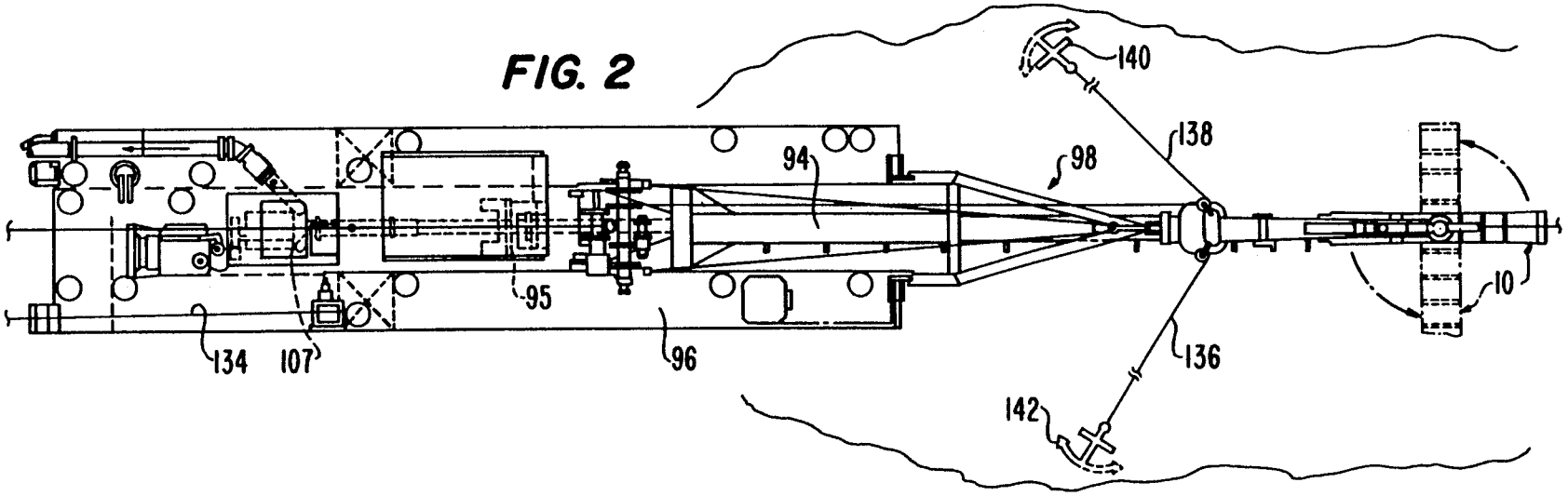
FIG. 2 is a top-plan view of the apparatus of FIG. 1.

Returning now to the structural part 77 of the digger frame and with particular reference to FIGS. 3, 5 6 and 10, the structural part 77 carries at its upper end an apertured plate 90 releasably connectible to a mating flange 92 (FIG. 3) carried by means to be described at the outer end of a dredge ladder 94 whose inner end is pivotally connected at 95 to a dredge barge 96, the ladder being raised and lowered in conventional manner by winches, cables and sheaves generally designated by the numeral 98 in FIGS. 1 and 2. As best seen in FIGS. 1 and 2 the apertured plate 90 carried by the dredging head permits the head to be connected to the ladder flange 92 in any one of a plurality of selected angular working positions relative to the axis of the ladder, at least one of these positions being transverse to the axis of the ladder as indicated by the dashed lines in FIG. 2 and at least another of these positions being parallel to the axis of the ladder as indicated by the full lines in FIG. 2.

As best seen in FIGS. 5, 6 and 10, the suction inlet opening 50 comprises an elongated passage extending through the horizontal frame component 18 parallel to the auger axis. Welded or otherwise fixed to the member 18 over the opening 50 is the lower end of an inverted, somewhat flattened, funnel-shaped hollow suction head 100 whose upper end merges with the lower end of a hollow cylindrical neck 101 whose upper end is fixed to the above mentioned apertured plate 90. Because the plate 90 supports the entire weight of the dredge head when attached to the ladder flange 92, the plate 90 is rigidly fixed to the auger frame by the structural part 77 which includes the previously mentioned paired side braces 76 between which are supported the upper ends of the shroud operating cylindrical 74, and sloping end braces 103.

As best seen in FIG. 3, the ladder flange 92 is at one end of a rigid 90° pipe elbow 104 whose opposite end is connected via a flexible conduit section 105 to a conventional suction pipe 106 carried by the ladder and connected in a conventional manner to a suction pump 107 (FIG. 1) on the barge.

In accordance with the invention means are provided for tilting the dredging head to selected angles relative the barge 96, and for automatically maintaining that angle constant as the ladder is raised and lowered. To this end and with reference to FIG. 3, the rigid elbow 104 is provided on its opposite sides with a pair of arms 108 which are rigidly fastened to the elbow. The free ends of the arms are pivotally connected at 110 to arms 112 rigidly connected to the outer end of the ladder 94. Also rigidly connected to the elbow 104 is a second arm 114 and connected between the outer end of arm 114 and the ladder 94 is a hydraulic power cylinder 116 whose opposite ends are connected by hydraulic lines 118, 120 to the opposite ends of a second hydraulic cylinder 122 connected between the barge 96 and ladder 94. From what has been described so far, if the selected position of the dredge head is horizontal as in FIG. 3, when the ladder is lowered the hydraulic fluid will be transferred via line 120 from the lower end of cylinder 122 to the outer end of hydraulic cylinder 116 causing the arm 114 to be rotated counter-clockwise, it being understood that the cylinders 122, 116 are designed to transfer fluid therebetween in step with angular changes of the ladder.

A simplified diagram is illustrated in FIG. 3 for preselecting the angle of tile of the dredging head. A three way valve 124 accessible to the dredge operator in the control cabin 126 on the barge can be actuated in one direction or the other from a central off position to connect a reservoir 127 via a pump 128 to a line, say 130, leading to one end of the cylinder 116 to expand the cylinder 116 and rotate the dredging head clockwise about the pivot 110. Fluid from the other end of the cylinder 116 is returned to the reservoir 127 via lines 132 and valve 124. When the valve 124 is returned to its off position, the preset angle of the dredging head relative to the barge remains as the ladder is raised and lowered.

It is believed that the operation and control of the dredging head of the invention should be clear from the foregoing description. For use in dredging operations, the unit will usually be positioned either parallel or transverse to the ladder axis. If the latter, the dredge can be operated in a known manner similar to a reel type lawn mower which is to say, the barge and head will be moved in a straight line either forwardly or backwardly by paying in and out on fore and aft anchor cables 133, 134, see FIGS. 1 and 2. When moving forwardly the leading shroud 54 will be raised and the trailing shroud 52 lowered. The anchor cables 133, 134 are fair-leaded so that the lead from the barge to the anchors are close to the water surface thereby minimizing any capsizing moment arm whenever the anchors are not in line with the fore and aft axis of the barge as is almost always the case during sweeping operations. For sweeping, the dredge head will be mounted parallel to the ladder axis as in FIG. 3 and the barge is swung back and forth by manipulating cables 136 and 138 for starboard and port swing anchors 140, 142, the fore and aft anchor cables 132, 134 permitting a much greater range of movement of the barge forwardly or rearwardly before the swing anchors must be re-located. If desired, the cable 134 may be located along the center line of the barge. If desired, conventional spuds can be used in the conventional spud wells 146 at the stern of the barge in place of the anchors and cables 133, 134.

Having now described the invention what is claimed is:

1. An auger type dredging head comprising an elongated inverted U-shaped frame having a vertical end components joined in spaced relation by a horizontal component, an auger digger having opposite ends journaled in said end components, said auger digger comprising first and second oppositely spiraled digging fins, power means carried by said frame for rotating said auger diggers in a direction wherein said fins propel dredged material in a direction towards the center of said frame, means carried by said frame for releasably connecting same to the end of a dredge ladder in any one of a plurality of preselected angular working positions with respect to the axis of said ladder, a suction pipe inlet opening into a region at the center of the auger digger in a position to receive dredged material propelled theretowards by said oppositely spiraled digger fins, first and second shrouds comprising arcuate wall parts substantially complementary in curvature to the circle defined by the radius of said auger digger, each of said wall parts having upper and lower edges spaced apart a distance substantially equal to the diameter of said auger digger and end edges spaced apart a distance substantially equal to the length of said auger digger, means pivotally connecting said shrouds to said frame, and power means carried by said frame for selectively moving said shrouds between raised and lowered positions with respect to said auger digger.

2. The auger type dredging head of claim 1 wherein the wall of each of said shrouds is provided with an opening centrally located relative to the end edges of said shrouds, outwardly opening door means biased inwardly to a position closing said opening but being responsive to the presence of dredged material too massive to be received into said suction pipe inlet to be opened by said material against said closing bias to permit ejection of said material to the exterior of said shroud.

3. The auger type dredging head of claim 2 wherein said openings include at least one edge parallel to the axis of rotation of said auger digger and hinge means connecting each of said door means to the respective shrouds adjacent said at least one edge.

4. The auger type dredging head of claim 3 wherein said at least one edge on one of said shrouds is adjacent the upper edge of said shroud and said at least one edge on the other of said shrouds is adjacent the lower edge of said shroud.

5. The auger type dredging head of claim 4 wherein each of said at least one edge of said openings is located on its respective shroud at a position which any point on said auger digger first approaches during rotation of said auger digger.

6. The auger type dredging head of claim 1 including first and second sets of sloping fins on the inner sides of the walls of said shrouds, each set of fins sloping in a direction complementary to the direction of spiral of said auger digger fins so that when a shroud is in a lowered position each set of said shroud fins cooperates with an auger digger fin to aid in guiding dredged material towards said suction pipe inlet opening.

7. The auger type dredging head of claim 1 including a dredge barge and a dredge ladder pivoted at its inner end to said dredge barge and having mounting means at its outer end for receiving said releasable connecting means carried by said frame, said mounting means being arranged, to permit said head to be connected to said ladder by said releasable connecting means in a plurality of selected angular working positions relative to the axis of said ladder, at least one of said positions being parallel to said axis and at least another of said positions being transverse to said axis.

8. The auger type dredging head of claim 7 including a suction pipe carried by said ladder, said mounting means having a rigid part pivotally connected to the outer end of said ladder, and defining a conduit for conducting dredged material from said suction pipe inlet opening to said suction pipe, an arm fixed at one end to said rigid part and connected at its other end to a first hydraulic power cylinder carried adjacent the outer end of said ladder, a second power cylinder between said ladder and barge, and hydraulic connections between said first and second power cylinders arranged that as the angular position of said ladder is changed with respect to said barge hydraulic fluid is transferred between said power cylinders to maintain a preset angular position of said dredging head with respect to a said barge regardless of the angular position of the ladder with respect to said barge.

9. The auger type dredging head of claim 8 including a flexible conduit connecting the conduit of said rigid member with said suction pipe.

10. The auger type dredging head of claim 4 including means for adjusting the angle of said head with respect to said barge when said head is in its one position parallel to the axis of said ladder, said adjusting means including means for automatically retaining said head in its adjusted angular position with respect to said barge as the angle of said ladder is changed with respect to said barge.

* * * * *